US005265596A

United States Patent [19]

Sauze

[11] Patent Number: 5,265,596

[45] Date of Patent: Nov. 30, 1993

[54] DEVICE FOR FEEDING BREATHING GAS

[75] Inventor: François Sauze, Laurent du Var, France

[73] Assignee: La Spirotechnique, Industrielle et Commerciale, Carros Cedex, France

[21] Appl. No.: 875,637

[22] Filed: Apr. 28, 1992

[30] Foreign Application Priority Data

May 2, 1991 [FR] France ..... 91 05388

[51] Int. Cl.[5] ..... A62B 7/04

[52] U.S. Cl. ..... 128/205.24; 128/204.26; 128/200.24; 137/908; 137/494

[58] Field of Search ..... 165/80.3, 80.1, 73, 165/177, 178, 181, 179, 182, 183, 80.2, 905, 180; 128/201.27, 204.25, 204.26, 205.24, 200.29, 204.21, 200.24, 201.21; 137/908, 494

[56] References Cited

U.S. PATENT DOCUMENTS

| | | | |
|---|---|---|---|
| 1,715,824 | 6/1929 | Duersten | 165/80.3 |
| 2,921,594 | 1/1960 | Mayo | 137/484.6 |
| 3,280,907 | 10/1966 | Hoffman | 165/183 |
| 3,731,738 | 5/1973 | Coopers | 165/180 |
| 4,026,283 | 5/1977 | Banjavich | 128/201.27 |
| 4,356,820 | 11/1982 | Trinkwalder, Jr. | 128/204.26 |
| 4,798,202 | 1/1989 | Chambonnet | 128/204.26 |
| 5,042,473 | 8/1991 | Lewis | 128/205.24 |
| 5,052,383 | 10/1991 | Chabert | 128/204.26 |
| 5,052,383 | 10/1991 | Chabert | 128/204.26 |
| 5,190,030 | 3/1993 | Semeia | 128/204.26 |

FOREIGN PATENT DOCUMENTS

| | | | |
|---|---|---|---|
| 2644750 | 9/1990 | France . | |
| 633376 | 12/1949 | United Kingdom | 165/80.1 |

OTHER PUBLICATIONS

Walker, Jim, "Oceanic's Delta Regulator," *Skin Diver* (Mar. 1992), pp. 16–17.

Halliday, David and Resnick, Robert, *Fundamentals of Physics 2nd ed.* New York: John Wiley & Sons, Inc., 1981.

*Primary Examiner*—Edgar S. Burr
*Assistant Examiner*—Eric P. Raciti
*Attorney, Agent, or Firm*—Young & Thompson

[57] ABSTRACT

The expansion valve unit, coupled to a lever of a diaphragm by means of a rod unit extending through the internal cavity of the housing, includes heat exchange with the surrounding medium, a rod support at the end of the rod unit opposite the valve unit, being also advantageously associated with a heat exchange unit so as to prevent icing, under the effect of expansion of the breathing gas into the housing, of the mechanical control train of the valve unit, in case of use in a cold surrounding medium.

11 Claims, 1 Drawing Sheet

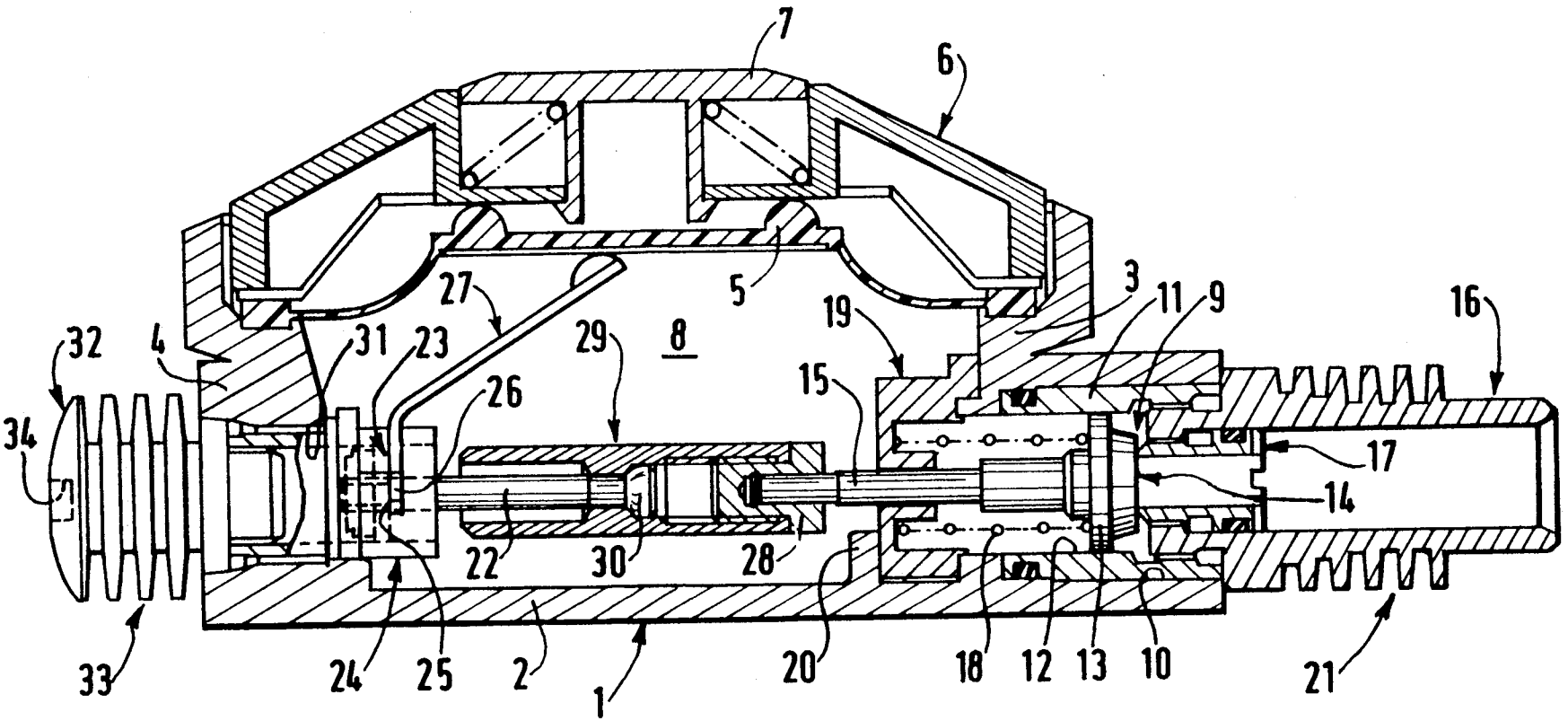
16
17
14
21
9
11
3
10
13
12
18
6
19
15
20
7
5
28
8
30
29
1
2
26
22
27
23
25
31
24
4
33
32
34

DEVICE FOR FEEDING BREATHING GAS

BACKGROUND OF INVENTION (a) Field of the Invention

The present invention concerns a breathing gas feeding device, more particularly for scuba diver, of the type comprising a housing defining an internal chamber bound by a flexible diaphragm, an expansion valve unit disposed in a first lateral wall of the housing and comprising a valve cooperating with a seat and unitary with a piston at a first end of a piston rod unit extending into the internal chamber and whose other end is coupled to a lever cooperating with the diaphragm.

(b) Description of Prior Art

A device of this type is described in the document FR-A-2.644.750, in the name of the Applicant. This type of device enables, through the diaphragm, a user to be able to rely on sufficient quantities of breathable gas and at the pressure of the surrounding medium, the expansion valve unit ensuring the required expansion of the breathing gas, which is supplied at a pressure higher than that of the surrounding medium. As mentioned in the above document, such an expansion results in a production of cold which is quite important in the housing, thus tending to substantially cool the mechanical control train of the valve unit. When the user operates in a surrounding at cold temperature, the temperature in the internal chamber goes down to a still lower value. The internal chamber often contains water, which penetrates therein through the breathing mouth piece. Moreover, the air which is exhaled by the user is saturated with humidity. The humidity which is present in the chamber is converted into ice upon contact with cold pieces, which may cause a blocking of the mechanical train of the valve unit. According to a first possibility enabling to overcome these disadvantages, the above document suggested to provide the rod assembly in a non-heat conductive material. The actual tendency being to produce the housings not with a metal but with a plastic material, the solution according to the first suggestion mentioned above was found to be insufficient.

SUMMARY OF INVENTION

It is an object of the present invention to propose a device of the type defined above which, while remaining of simple construction and of low manufacturing cost, enables to substantially improve the resistance to icing in surroundings under cold but slightly negative temperatures, as it is the case with scubadiving in particular.

For this purpose, according to a characteristic of the invention, the expansion valve unit includes means for heat exchange with a medium surrounding the device.

According to a more specific characteristic of the invention, the valve seat is mounted in a tubular element of heat conductive material having an outer part extending outside the housing and a shape providing a substantial exchange surface with the surrounding medium, typically fins.

According to another characteristic of the invention, the other end of the rod unit is guided in a tubular rod support mounted in a second lateral wall of the housing opposite the first lateral wall and associated with means for heat exchange with the medium surrounding the device, the rod support being typically coupled to an obturation member including an outer part having a shape providing a substantial surface exchange with the surrounding medium, for example fins.

With such an arrangement, the frigories produced in the device by expansion of the breathing gas are evacuated in the surrounding medium through the heat exchange means, essentially at the level of the expansion valve unit and, in case of an extended use of the device in a cold surrounding, also at the level of the articulated link between the rod and lever unit, thus preventing risks of icing at this location.

The present invention preferably finds application in the second stage of a compressed air breathing apparatus, such as for sub-marine scubadiver but may also find application in the first stage of expansion of such an apparatus.

BRIEF DESCRIPTION OF DRAWINGS

Other characteristics and advantages of the present invention will appear from the description which follows of an embodiment, given by way of illustration but without limitation, with reference to the annexed drawing on which:

the single FIGURE is a schematic illustration in cross-section of a second stage of expansion in scubadiving.

DESCRIPTION OF PREFERRED EMBODIMENT

On the single figure, there is shown a housing 1 in the form of a vat, with a bottom 2 and two portions of opposite lateral walls 3 and 4. The vat is closed by means of a flexible diaphragm of elastomeric material 5, which is protected by an external hood 6 including a push-button for resetting force feeding 7. The housing 1 and the diaphragm 5 thus define an internal chamber 8 which communicates through a duct with a mouth piece (not illustrated) and which is supplied with a breathing gas by means of an expansion valve unit, generally designated by reference 9, disposed in the first lateral wall portion 3. The later is formed with a recess 10 in which there is mounted a tubular valve body 11 defining an internal bore 12 in which a piston 13 is slidably mounted, one end of the piston carrying an elastomeric valve member 14 which is prolonged, opposite valve 14, through a rod 15 which extends through internal chamber 8.

According to the invention, a tubular member 16 including an exterior part extending outside the housing and intended to be connected to a tube for introducing breathing gas under pressure (not illustrated) is screwed into valve body 11. The tubular member 16 includes, at its interior end a thread receiving a tubular member 17 whose interior bevelled end defines a seat for valve 14. The piston 13-valve 14 combination is drawn towards seat 17 through spring 18 which rests on a deflector 19 mounted on the lateral wall 3, inside internal chamber 8, and defining a guide for rod 15. The deflector 19 is blocked into position against lateral wall 3 by means of a projection 20 extending from the bottom 2 of the housing 1 inside chamber 8.

According to an aspect of the invention, the outer part of the tubular member 16 is typically formed of a plurality of circular fins 21 to establish heat exchange between the surrounding medium and the unit consisting of tubular member 16, seat body 17 and valve body 11.

According to a preferred aspect of the invention, the piston rod 15 is coaxially connected to a second rod 22 of which the end opposite piston rod 15 carries a ring 23 sliding in an internal bore of a tubular rod support 24 mounted on the second part of lateral wall 4 opposite valve unit 9. The rod support 24 includes two lateral openings 25 through which two fingers 26 extend to cooperate with ring 23. The two fingers 26 are part of an end in the form of a fork of a control lever 27 in which the other end is in cooperating contact with the diaphragm 5.

More specifically, as illustrated in the figure, the piston rod 15 is screwed into a hood 28 of insulating plastic material, for example, of an acetal resin which itself is screwed into a threaded end of tubular connector 29, also of insulating plastic material, for example acetal resin, in which a widened head 30, for example spherical, is fixed at the end of rod 22 opposite ring 23.

According to an aspect of the invention, the rod and lever support 24 is mounted in an opening 31 which extends through the lateral wall 4 and is associated by screwing in an inner threaded end of a cylindrical closure and fixation member 32 including an outer part which, as the outer part of tubular member 16, is shaped with a series of circular fins 33, the cylindrical member 32 being provided at its outer end, with a housing 34 enabling it to be screwed with rod support 24.

According to a practical embodiment, the piston 13-valve 14-piston rod 15 combination, the rod 22 and the lever 27 are made of stainless steel. The hood 19 is made of the same plastic material as housing 1, for example of phenylene polyoxide or polyurethane. The seat body 17, the valve body 11, r the rod support 24 are made of chromium brass. The tubular member 16 and the cylindrical member 32 are made of brass provided with a surface treatment, for example chromium.

Although the present invention has been described with respect to an embodiment, it is not limited thereto but on the contrary, it is capable of modifications and variants which will appear to one skilled in the art.

I claim:

1. A breathing apparatus, comprising a housing made out of a first material supporting a flexible diaphragm and defining, with the diaphragm, an internal chamber, the housing having a first side wall, an expansion valve unit housed in the first side wall and including a seat member mounted in a tubular member protruding from the first side wall and a movable valve assembly resiliently biased in engagement with the seat member, said tubular member having a first portion received within said housing and a second portion extending outside said housing and connectable to a breathing gas supply, said seat member being disposed in said second portion, and a hinged actuating means housed in the internal chamber and mechanically coupling the valve member to the diaphragm, wherein the tubular member of the valve unit is made out of a second material having heat conducting properties substantially greater than the first material and is provided on its outer periphery with heat exchange means exposed to medium surrounding the apparatus for increasing the rate of heat transfer between said surrounding medium and said tubular member.

2. The apparatus of claim 1, wherein the tubular member has outwardly extending fins.

3. The apparatus of claim 2, wherein the seat member is made out of said second material.

4. The apparatus of claim 1, wherein the tubular member is connected to a tubular valve body housing the valve assembly and fitted within the first side wall.

5. The apparatus of claim 4, wherein the valve body is made out of said second material.

6. The apparatus of claim 4, wherein the valve assembly is biased by a spring housed in the valve body and bearing against a flange member out of a non heat-conducting material separating the valve unit from the internal chamber.

7. The apparatus of claim 1, wherein the hinged actuating means comprises a rod assembly extending through the internal chamber and having a first end connected to the valve assembly and a second end guidably received within a tubular support member mounted in a second side wall of the housing, opposite the first side wall, and connected to an outer member protruding outwardly out of the housing and having an outer shape providing a substantial heat exchange surface with the medium surrounding the apparatus.

8. The apparatus of claim 7, wherein the outer member has outwardly extending fins.

9. The apparatus of claim 7, wherein the outer member is made out of the second material.

10. The apparatus of claim 9, wherein the second material consists essentially of brass.

11. The apparatus of claim 10, wherein the first material is a plastic material.

* * * * *

US005265596C1

(12) REEXAMINATION CERTIFICATE (4804th)

United States Patent

Sauze

(10) Number: US 5,265,596 C1

(45) Certificate Issued: Jul. 8, 2003

(54) DEVICE FOR FEEDING BREATHING GAS

(75) Inventor: François Sauze, Laurent du Var (FR)

(73) Assignee: La Spirotechnique, Industrielle et Commerciale, Carros Cedex (FR)

Reexamination Request:
No. 90/006,193, Jan. 15, 2002

Reexamination Certificate for:

| | |
|---|---|
| Patent No.: | **5,265,596** |
| Issued: | **Nov. 30, 1993** |
| Appl. No.: | **07/875,637** |
| Filed: | **Apr. 28, 1992** |

(30) Foreign Application Priority Data

May 2, 1991 (FR) ..... 91 05388

(51) Int. Cl.[7] ..... A62B 9/02; A62B 7/04

(52) U.S. Cl. ..... 128/205.24; 128/200.24; 128/204.26; 137/494; 137/908

(58) Field of Search ..... 128/200.24, 201.13, 128/201.27, 201.28, 205.24, 204.26, 207.14, 207.18; 137/59–62, 78.1, 505, 334, 908, 494; 165/80.3

(56) References Cited

U.S. PATENT DOCUMENTS 3,628,532 A * 12/1971 Magrath ..... 128/204.17
4,356,820 A * 11/1982 Trinkwalder, Jr. ..... 128/204.26
4,967,780 A * 11/1990 Minami ..... 137/60

* cited by examiner

*Primary Examiner*—Glenn K. Dawson

(57) ABSTRACT

The expansion valve unit, coupled to a lever of a diaphragm by means of a rod unit extending through the internal cavity of the housing, includes heat exchange with the surrounding medium, a rod support at the end of the rod unit opposite the valve unit, being also advantageously associated with a heat exchange unit so as to prevent icing, under the effect of expansion of the breathing gas into the housing, of the mechanical control train of the valve unit, in case of use in a cold surrounding medium.

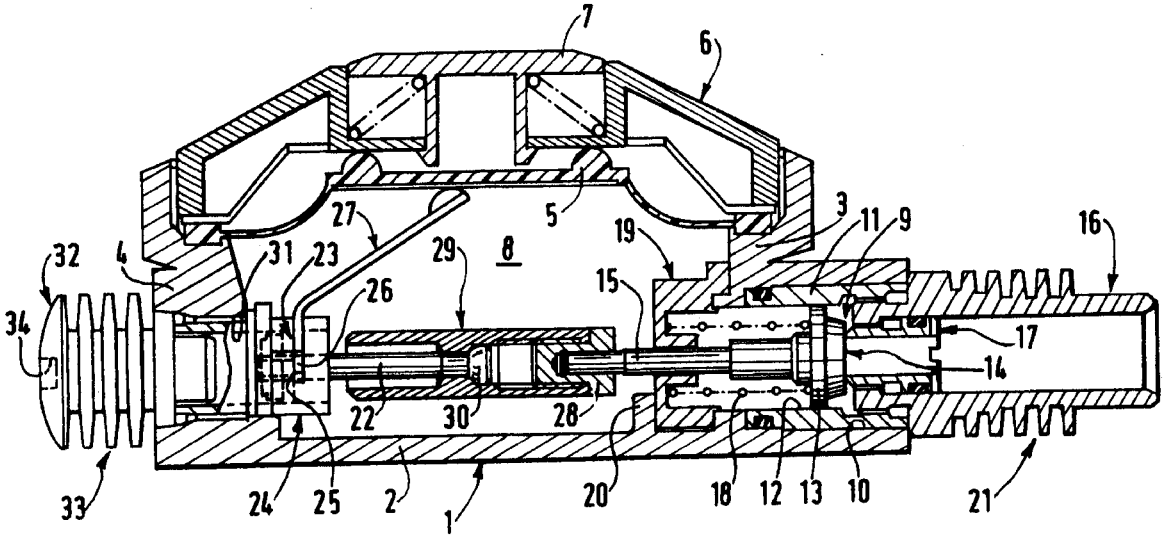

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *